United States Patent [19]

Bossert et al.

[11] Patent Number: 4,767,372

[45] Date of Patent: Aug. 30, 1988

[54] PROCESS FOR THE PRODUCTION OF A POROUS PRESSED PART

[75] Inventors: Frank Bossert, Ulm; Manfred Hacker, Illerkirchberg, both of Fed. Rep. of Germany

[73] Assignee: Licentia Patent-Verwaltungs-GmbH, Fed. Rep. of Germany

[21] Appl. No.: 1,586

[22] Filed: Jan. 9, 1987

[30] Foreign Application Priority Data

Jan. 10, 1986 [DE] Fed. Rep. of Germany ..... 3600480

[51] Int. Cl.[4] ..... H01J 9/04

[52] U.S. Cl. ..... 445/50; 313/346 DC; 419/2; 419/8

[58] Field of Search ..... 419/8, 9, 2, 38; 445/50, 51; 313/346 R, 346 DC

[56] References Cited

U.S. PATENT DOCUMENTS

| | | | |
|---|---|---|---|
| 2,747,231 | 5/1956 | Reinhardt | 419/38 |
| 3,842,309 | 10/1974 | Van Stratum et al. | 313/346 R X |
| 4,310,775 | 1/1982 | Heynisch | 313/346 DC X |
| 4,478,590 | 10/1984 | Rychlewski | 445/50 |

FOREIGN PATENT DOCUMENTS

| | | | |
|---|---|---|---|
| 782138 | 9/1957 | United Kingdom | 313/346 DC |

*Primary Examiner*—Kenneth J. Ramsey

*Attorney, Agent, or Firm*—McGlew and Tuttle

[57] ABSTRACT

To improve the homogeneity of the porosity of a concave-convex pressed part with minimized mass, a precompressed pressed part with plane frontal surfaces is produced in a first process step. This part is then further compressed to produce a concave-convex sintered pressed part in a further process step. The pressed part can, however, also be produced in only one process step, if the requirements for homogeneous porosity distribution are less.

21 Claims, 1 Drawing Sheet

PROCESS FOR THE PRODUCTION OF A POROUS PRESSED PART

FIELD AND BACKGROUND OF THE INVENTION

The present invention relates in general to methods for pressing and forming powders to solid objects, and in particular to a new and useful process for producing a porous part having opposite concave and convex surfaces.

In order to be able to produce cathodes for travelling wave tubes which heat up quickly, the cathode mass must be as small as possible.

A reduction of the cathode mass however, is only possible by way of the thickness of the cathode pill, if the current density is predetermined (current per emission surface). In order to meet electron-optical requirements, the emitting surface has to be concave.

Another important requirement is uniform electron emission over the entire cathode surface, which results in the requirement of homogeneous porosity of the matrix element.

Attempts are made to meet these requirements by pressing metal powder (as a rule, tungsten or tungsten mixed with Os, Ir, Ru, Re) as cylindrical, plane-parallel elements with sufficient thickness in a so-called cathode holder, sintering them at a high temperature, and subsequently producing the concave shape by mechanical processing. This direct pressing of the powder in the cathode holder has the advantage, as compared with processes in which cathode pills are produced without a cathode holder, that the holder element necessary for attachement in the tube system is already rigidly connected to the cathode after sintering, and that additional processes, such as soldering or welding, for example, are not necessary. By pressing plane-parallel elements, sufficiently homogeneous porosity distribution is guaranteed.

Both processes (with or without the cathode holder) have the disadvantages, however, that production of the concave shape is complicated and expensive (in particular when the concave shape is deep) and that the cathode mass becomes significantly greater than necessary, since essentially, only a concave-convex disk with a constant thickness is needed.

If an attempt is made to produce the concave cathode surface right away, during pressing, by giving the top die a convex shape, then non-homogeneous porosity distributions are produced, particularly in the case of deep concave shapes, because of non-homogeneous compression of the metal powders.

If an attempt is made, in addition to this, to reduce the cathode mass, by giving the cathode holer bottom a concave shape, then the non-homogeneous porosity distribution is even further increased.

If pressing is carried out without a cathode holder, extremely difficult and time-consuming processing of the spherical surfaces on both sides must be carried out; this becomes critical in particular when one considers that porous pills with thicknesses from 150 to 300 $\mu$m are desired.

In addition, there is the difficult problem of attachment of the cathode pill and suppression of lateral and rearward electron emission, and evaporation of emission material.

SUMMARY OF THE INVENTION

The present invention is based on the task of improving a process of the type stated initially in such a way that pressed parts with low thickness and high uniformity of porosity, which are easily attached, are produced, with these parts being used preferably as supply elements for dispenser cathodes of electron-beam tubes.

Accordingly an object of the present invention is to provide a process for producing a porous pressed part having concave and convex opposite surfaces and which is particularly useful as a supply element for a matrix cathode of an electron beam tube, comprising pre-compressing a powder to form a pre-compressed part with opposite flate surfaced, further compacting the pre-compressed part using a dye with a concave face on one flat surface and a die with a convex face on the other surface and pressing the dies together to form the porous pressed part with opposite concave and convex surfaces.

A further object of the invention is to produce the porous pressed part by precompressing the precompressed part in a pot-shaped holder or against a flat plate, and thereafter compressing the precompressed part along with the pot-shaped holder or plate.

The process described is suited for producing powder metallurgical or ceramic sintered elements with concave-convex surface, with homogeneous porosity distribution, with the mass of the element and the effort for final processing being minimized. Such sintered parts can be used, for example, as current resistors, filters, permanently lubricated or self-lubricating bearing parts or preferably porous elements for matrix cathodes in electron-beam tubes.

Essential advantages of the process according to the invention for the production of a dispenser cathode are:

A pot-shaped holder part with a plane base is used. This cathode holder does not receive its final shape until pressing. Becasue the bottom of the cathode holder is plane at first, homogeneous compression and therefore homogensous porosity is possible over the entire surface, although concave and convex dies are used.

Because of the use of a thin-walled cathode holder, extremely thin cathode pills with a minimized mass can be produced without complicated and time consuming final processing.

Because of the cathode holder described, and the solder-free (sintered) connection between the cathode pill and the holder element, even extremely thin cathodes can be integrated in a tube system without problems.

In the case of large cathodes with deep concave shapes, significant savings in material and processing time are possible; this is particularly important when platinum metals are being used, as in so-called MM cathodes (mixed metal cathodes).

The process described can be carried out with relatively thick pills even without a pot-shaped cathode holder, if a thin metal plate is inserted instead of the pot.

The various features of novelty which characterize the invention are pointed out with particularity in the claims annexed to and forming a part of this disclosure. For a better understnding of the invention, its operating advantages and specific objects attained by its uses, reference is made to the accompanying drawings and descriptive matter in which prefered embodiments of the invention are illustrated.

DESCRIPTION OF THE PREFERRED EMBODIMENTS

The process is explained using the example of a matrix cathode for traveling wave tubes which heats up rapidly. For this application, the process according to the invention is very advantageous particularly if relatively large cathodes ($\phi > 3$ mm) with deep concave shapes are needed.

Figure 1:
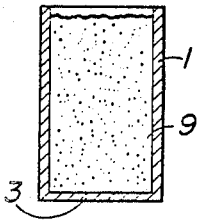
FIG. 1 is a side sectional view of a holder containing powder to be compressed into the porous pressed part of the present invention.
Figure 2:
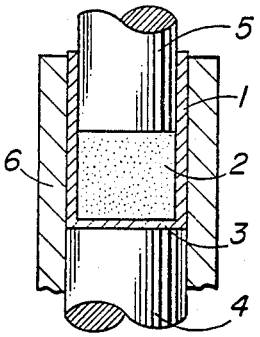
FIG. 2 is a side sectional view showing the step of precompressing the powder.
Figure 3:
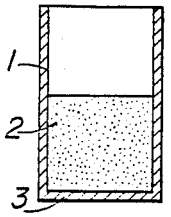
FIG. 3 is a side elevational view of the precompressed powder in its pot-shaped holder.

A thin-walled, pot-shaped cathode holder, for example with a thickness of 50 to 222 $\mu$m, 1 with a plane bottom 3 is used. The height of this cylindrical pot is equal to or slightly greater than the so-called dumping height of the loose powder 9 for a corresponding pill thickness, as shown in FIG. 1. The dumping height is the height of the amount of powder 9 when it is just dropped into the holder 1 without any compression. The precisely measured amount of powder is pre-compressed in this pot 1 with slight pressure and a plane upper die 5 so that a parallel layer 2 with a moderate density is formed. In FIG. 2, the other parts of the tool are designated and 4 and 6. FIG. 3 shows the cathode holder 1 with the precompressed pressed part 2. The press for the further steps of the process consists of a matrix 6, into which the cathode holder 1 fits with as little play as possible. The lower die 8 has a concave frontal surface and also fits into the matrix 6 without play.

Figure 4:
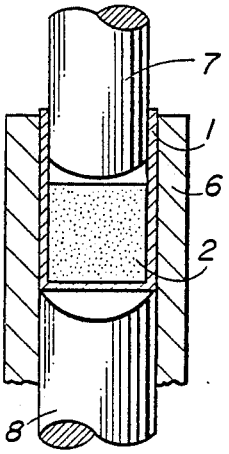
FIG. 4 is a side sectional view showing the step of compressing the precompressed part using dies having concave and convex surfaces.

The upper die 7 has a convex frontal surface and fits into the cathode holder relatively easily (FIG. 4).

The radii of the two dies are dimensioned in such a way that the desired shape of the emitting surface of the cathode and, at the same time, a disk with a constant thickness are formed.

Figure 5:
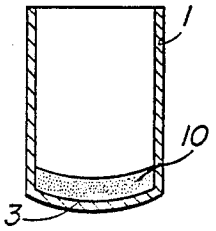
FIG. 5 is a side sectional view showing the the porous pressed part after it has been compressed by the dies of FIG. 4.
Figure 6:
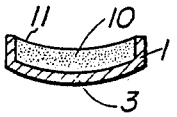
FIG. 6 is a view similar to FIG. 5 showing the pressed part after an extension of the pot-shaped holder has been removed.

For pressing, the cathode holder 1 is placed in the matrix 6 with the precompressed pressed part 2 and the cathode pill 10 is pressed with the necessary pressure. Since the two dies 7 and 8 have a convex and concave shape and the plane bottom 3 of the cathode holder 1 is also shaped during the pressing process, the cathode pill is given the desired shape, as a thin concave/convex disk 10, as shown in FIGS. 5 and 6, without any mechanical final processing being necessary. Only the projecting part of the cathode holder 1 is removed (FIG. 6). The emission surface is designated as 11.

Since the dumping height in the cathode holder, which was plane at first, was the same over the entire surface, and the ability of the individual powder particles to slip was drastically reduced by the pre-compression, the compression and therefore also the porosity distribution in the concave/convex disk are homogeneous.

The pressed part is then hardened by sintering at an elevated temperature. This porous sintered element, for example consisting primarily of tungsten, is then impregnated with an emission material in a known manner. Attachment of the holder 3 is carried out on a cathode sleeve, in the cavity of which the cathode heating element is located.

A cathode produced in such a way demonstrates extraordinarily advantageous heating behaviour, so that it can be used in electron beam tubes that heat up rapidly, but also in satellite tubes with a long lifespan as well as in power tubes with very large cathodes.

Rather than using the pot-shaped holder 1 shown in FIG. 1, which as the plane bottom or flate plate 3 plus a cylindrical side wall, the flat bottom plate 3 can be used alone to support the amount of powder material, which can be loaded directly into the matrix for die tube 6 shown in FIG. 2.

The pot-shaped container 1 or flat plate 3 by itself can be made of metal having a high melting point, particularly molybdenum or nickel. The holder or plate can also be made of material which is thermally decomposed before or during sintering of the powder pressed part, or which can be chemically removed after sintering.

The powder 9 can be a metal powder, in particular powder of metals with high melting point. The metal powder can also be a mixture, in particular a tungsten powder mixed with IR, Os, Re or Ru powder.

The tungsten powder with 10 to 15 volume-percent iridium or osium powder may be used.

The pressed part shown in FIGS. 5 and 6 can also be impregnated with an emission material so that it can be used as the cathode of an electron tube.

Ceramic powder can also be used as the initial powder 9.

While specific embodiments of the invention have been shown and described in detail to illustrate the application of the principles to the invention, it will be understood that the invention may be embodied otherwise without departing from such principles.

What is claimed is:

1. A process for producing a porous matrix which may be soaked in emission material having opposite concave and convex surface, comprising precompressing a powder to form a precompressed part with opposite flat parallel surfaces, thereafter compressing the pre-compressed part by applying a first die with a concave face against one of the flat surfaces and a second die with a convex face against the other flat surface and pressing the first and second dies together to provide a uniform thickness.

2. A process according to claim 1, including holding the powder to precompressed and to be pressed, in a pot-shaped holder having a flat bottom plate against which one of the flat surfaces is engaged, and pressing the flat bottom plate along the flat surface to form one of opposite concave and convex surface.

3. A process according to claim 1, including providing a flat bottom plate against one of the flat surfaces and pressing one of the first and second dies against the flat plate to bend the flat plate and the flat surface engaged against the flat plate into one of the concave and convex opposite surfaces.

4. A process according to claim 1, including engaging a flat plate against the powder, precompressing said powder to form one of the opposite flat prallel surfaces against the flat plate, and compressing the one flat surface along with the flat plate using one of the dies to form one of the opposite concave and convex surfaces.

5. A process according to claim 2, wherein the pot-shaped holder is made of metal having a high melting point.

6. A process according to claim 3, wherein the flat plate is made of metal having a high melting point.

7. A process according to claim 2, including sintering the part compressed by the dies and making the holder out of material which is thermally decomposed before or during the sintering.

8. A process according to claim 3, including sintering the part compressed by the dies, the flat plate being made of material which thermally decomposes before or during sintering.

9. A process according to claim 2, including sintering the part compressed by the dies and chemically removing the holder after the sintering step.

10. A process according to claim 3, including sintering the parts compressed by the dies and chemically removing the flat plate after the sintering step.

11. A process according to claim 1, wherein the powder comprises metal powder.

12. A process according to claim 11, wherein the metal powder has a high melting point.

13. A process according to claim 12, wherein the metal powder includes tungsten powder.

14. A process according to claim 13, wherein the metal powder comprises a mixture of tungsten powder and at least one of Ir, Os, Re and Ru powder.

15. A process according to claim 14, wherein the metal powder is a mixture of tungsten powder with ten to fifteen volume percent of powder selected from iridium and osmium.

16. A process according to claim 2, including sintering the part compressed by the dies, the holder being made of material which is mechanically connected to the powder when the part compressed by the dies is sintered to form a porous cathode element having great strength.

17. A process according to claim 3, including sintering the part which is compressed by the dies, the flat plate being made of material which is mechanically connected to the part upon sintering the part to form a porous cathode element with great strength.

18. A process according to claim 2, including impregnating the cathode holder and part compressed by the dies with emission material useful to produce a cathode for electron beam tubes.

19. A process according to claim 1, wherein the powder comprises ceramic powder.

20. A process for producing a porous pressed part having opposite concave and convex surface, comprising holding a powder in a pot-shaped holder having a flat bottom plate; pre-compressing the powder to form a pre-compressed part with opposite flat parallel surfaces, one of the flat surfaces being engaged with the flat bottom of the pot-shaped holder; thereafter compressing the pre-compressed part by applying a first die with a concave face against one of the flat surfaces and a second die with a convex face against the other flat surface, and pressing the first and second dies together to provide a uniform thickness, the flat bottom plate along the flat surface being pressed to form one of the opposite concave and convex surfaces; and, sintering the part compressed by the dies and removing the holder by one of making the holder out of material which is thermally decomposed before or during the sintering and chemically removing the holder after the sintering step.

21. A process for fabricating a porous matrix which may be soaked in emission material, the fabricated porous matrix having a concave facial front for a matrix cathode of an electron-beam tube, comprising the steps of: fabricating a pre-compressed matrix having the plane facial fronts, each front being parallel to the other; and, compressing the pre-compressed matrix by applying a first die with a concave face against one of the plane facial fronts and a second die with a convex face against the other plane facial front to form a porous matrix with a uniform thickness with one concave and one convex facial front.

* * * * *